United States Patent [19]

Jones

[11] 4,111,482

[45] Sep. 5, 1978

[54] FOLDING TABLE AND SEAT ASSEMBLY

[75] Inventor: William C. Jones, Midland, Mich.

[73] Assignee: Franklyn M. Markus, Cote St. Luc, Canada

[21] Appl. No.: 842,573

[22] Filed: Oct. 17, 1977

[51] Int. Cl.[2] ..... A47B 39/00

[52] U.S. Cl. ..... 297/159; 108/36

[58] Field of Search ..... 108/64, 36, 113, 112, 108/133, 132, 131; 297/159, 17; 248/188.6, 206 A

[56] References Cited

U.S. PATENT DOCUMENTS

| | | | |
|---|---|---|---|
| 2,643,926 | 6/1953 | Pucci | 108/36 X |
| 2,825,390 | 3/1958 | Post | 297/159 X |
| 2,836,475 | 5/1958 | Sapp | 108/64 |
| 2,868,599 | 1/1959 | Roggio | 108/64 X |
| 2,939,516 | 6/1960 | Drew | 297/159 |
| 3,174,796 | 3/1965 | Brown | 297/159 |
| 3,641,947 | 2/1972 | Finney | 248/206 A |
| 4,052,100 | 10/1977 | Nikitits et al. | 297/159 |

FOREIGN PATENT DOCUMENTS

| | | | |
|---|---|---|---|
| 607,273 | 4/1960 | Italy | 297/159 |

*Primary Examiner*—James T. McCall

*Attorney, Agent, or Firm*—Hubbell, Cohen, Stiefel & Gross

[57] ABSTRACT

A folding table and seat assembly is provided having a table support member fixedly connected to a seat support member. The table support member is pivotally mounted to the table for movement between opened and closed positions. Leg means are pivotally connected to the seat support member and act to support the entire table and seat assembly when swung open.

24 Claims, 19 Drawing Figures

12
14
14a
18
19a
22a
22b
26a
30a
32
34
36
38a
38b
40
42
44
46
48
49
50
52
54
56
58
60
62
64
68
70
72
74
76
78
98

7
10
12
14a
14b
18
19a
19b
22a
22b
26a
26b
30a
30b
32
34

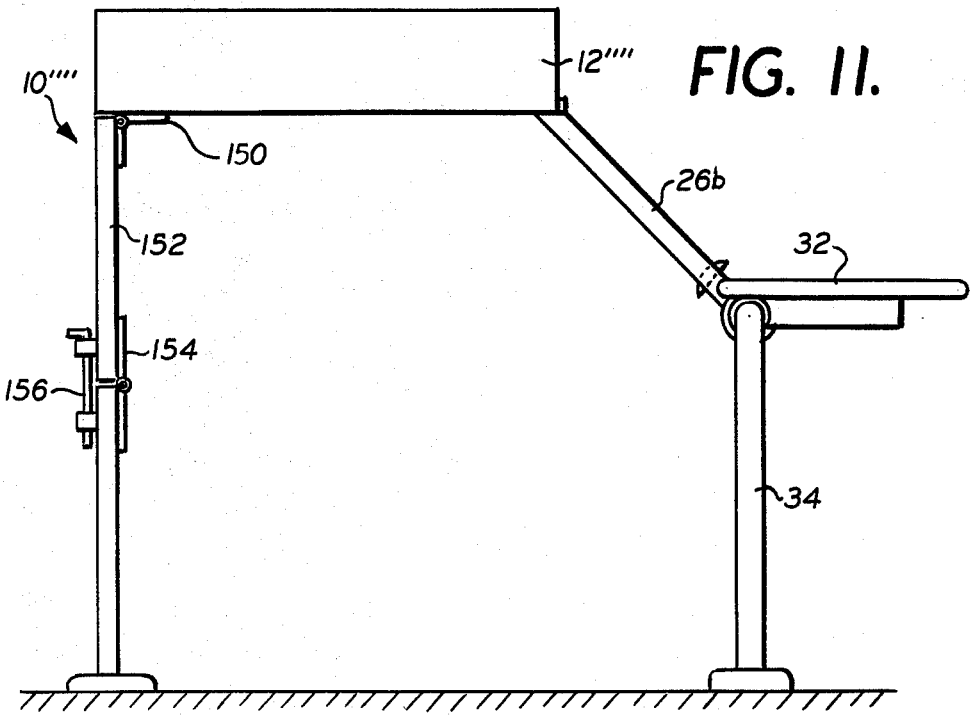
FIG. 11.
FIG. 15.
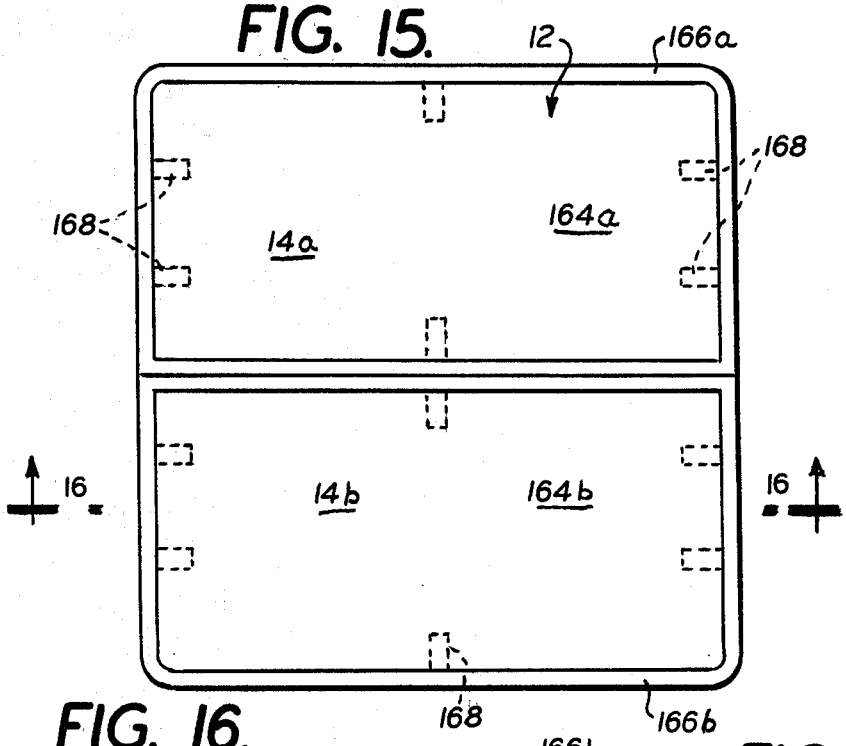
FIG. 16.
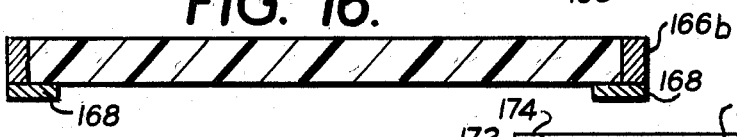
FIG. 17.
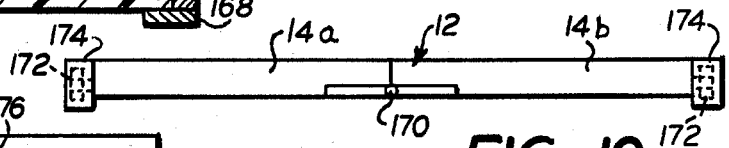
FIG. 18.
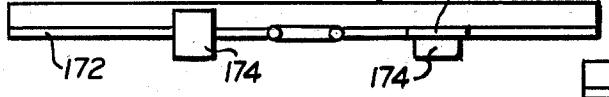
FIG. 19.
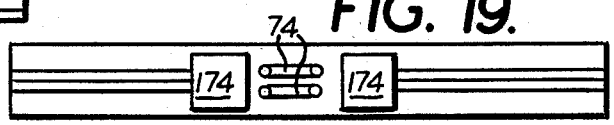

FOLDING TABLE AND SEAT ASSEMBLY

BACKGROUND OF THE INVENTION

1. Field of the Invention

This invention relates generally to table and seat assemblies, and more particularly to such assemblies wherein the table and seat can be folded between opened and closed configurations.

2. Description of the Prior Art

As the society has become increasingly mobile through the greatly expanded use of the automobile, more and more families seek to picnic along the side of a road or in a secluded spot. While, often times, prepared picnic facilities are provided, these are generally crowded and are commonly located at sites that are cultivated. Many people prefer to picnic by themselves in more natural surroundings where no dining facilities are available. Also, one often finds no permanent picnic facility at the time he wishes to eat. This generally leads to the use of a picnic blanket or the like which is uncomfortable and often untidy. Thus, there is a growing need for a portable dining facility in the form of a collapsible table and chair assembly.

A similar need has arisen in schools and other public facilities such as conference rooms which use unstructured classroom arrangements. In such arrangements, it is often desirable to clear a room entirely of tables and chairs for certain school activities. To remove standard classroom desks and chairs is an impractical solution to that problem and thus a need for a collapsible chair and desk has arisen.

The need for lightweight and durable collapsible tables and chairs has been recognized for a long time. Thus, for example, in Bassford U.S. Pat. No. 1,272,187 granted on July 9, 1918, a collapsible combined table and seats is disclosed. This Bassford assembly was, by virtue of the nature of the collapsing movements of the various components, relatively large in its collapsed condition. Moreover, there are a number of detachable elements which must be disconnected before collapse is effected and must be connected when operating it to its open position. In U.S. Pat. No. 1,514,418 granted to J. N. Battenfield on Nov. 4, 1924, a combined folding table and seat is disclosed which includes a complex collapsible linkage that is necessarily of substantial weight if it is to have adequate rigidity. Moreover, during the assembly and disassembly of the Battenfield structure, a variety of elements must be disconnected from one another. In the Peterson U.S. Pat. No. 1,641,010, a collapsible table or chair or seat arrangement is disclosed. This arrangement however has a multiplicity of detached separate parts which must be joined to assemble the assembly. This is not convenient and is time consuming. Moreover, because of the number of separate joints in the Peterson device, it is difficult to make such a device rigid without utilizing heavy costly parts. Similarly, in the patent granted to L. Wing on June 11, 1929, U.S. Pat. No. 1,716,612, a collapsible combined table and seat is disclosed. However, the nature of the support of the table on the seats is such as to render the structure somewhat unstable. In Soltesz U.S. Pat. No. Re. 18,207 granted Sept. 22, 1931 still another collapsible combined table and seat is disclosed. This structure requires complex toggle linkages and numerous separate operations for assemblying and disassemblying for combined assembly. Also, the structure precludes access from the sides of the seat, thereby rendering it inconvenient in use. On Oct. 8, 1940, a patent was granted to F. Weber, U.S. Pat. No. 2,217,576, which patent is directed to a collapsible folding table and seat. This device requires complex sliding linkages which would prove to be heavy and costly. In U.S. Pat. No. 2,558,465 granted to P. M. Seymour on June 26, 1951, another combined table and bench assembly is disclosed. This table and bench assembly relies heavily on chainlike tension members for stiffness, which members are heavy. Also, the nature of the assembly is such that the table in the Seymour assembly will not be as stable as is required for normal dining use. Likewise, in U.S. Pat. No. 2,647,562 granted to C. F. Hoffar on Aug. 4, 1953, a combined collapsible table and seat assembly is disclosed. However, the Hoffar structure also includes complex linkages and requires a large number of independent operations for opening and closing the assembly. In addition, the Hoffar assembly includes linkages which preclude access from the sides of the benchlike seats and thereby render the assembly difficult to use. Post Pat. No. 2,991,829 granted on July 11, 1961 likewise discloses a combined collapsible table and seats. This, again, includes complex toggle linkages and requires a variety of separate and distinct operations for opening and closing the assembly. Similar limitations exist in the structures illustrated and described in French Pat. Nos. 1,054,743 and 1,092,230. French Pat. No. 988,168 relies on a flaccid seat which is not wholly rigid in use and the support for the table top is a parallelogram which is inherently less stable than triangular supports. In U.S. Pat. No. 3,141,424 which was granted to P. M. Seymour on July 21, 1964, yet another combined table and seat assembly is disclosed. This assembly does not collapse compactly and it also includes relatively difficult to make cam tracks in its linkage. Finally, in U.S. Pat. No. 3,256,037 granted to J. Giambaldo on June 14, 1966, yet another form of combined table and seat is disclosed. This structure is inconveniently heavy and the linkage employed therein will not yield as rigid a structure as is required.

From the review of the prior art above presented, it will be seen that there have been numerous attempts over many years to produce a lightweight, easily unfolded and folded, combined collapsible table and seat. However, each prior art proposal has fallen somewhat short of the mark. As a result, there has been no significant commercial success for any of the prior art devices known to applicants.

I recently filed U.S. application Ser. No. 707,111, dated July 20, 1976, directed to a different combined folding table and seat assembly than that disclosed herein. The contents of said application are hereby incorporated by reference in its entirety.

SUMMARY OF THE INVENTION

A folding table and seat assembly is provided having a table support member connected at one end to the underside of a table for relative pivotal movement and an elongated seat support member fixedly joined to the other end of the table support member. The seat support member has a circular axial bore extending longitudinally therethrough. A pair of elongated legs are mounted to the seat support member by leg mounting means which includes a circular shaft extending through the axial bore in the seat support member for rotatable movement therein. Both ends of the shaft are connected to the elongated legs, respectively. A seat base is mounted to the seat support member for relative pivotal movement, and includes a boss having a circular aperture through which the seat support member extends.

The table may also comprise a pair of tabletop portions connected to each other for relative pivotal movement, each of the tabletop portions having a respective table support member connected therebeneath. Further, means can be mounted on the seat support member to releasably hold the legs at a fixed opened position, such means including a lock pin which extends through registered apertures in the seat support member and the circular shaft connecting the legs when the legs are moved in unison to the opened position.

It will be understood from the description below as read together with the accompanying drawings that the table and seat assembly of the present invention provides an easily fabricated structure which is rigid when in use, and yet is readily collapsible to provide both utility and convenience such as not heretofore attained.

BRIEF DESCRIPTION OF THE DRAWINGS

FIG. 11 is a side elevational view of still another form of combined table and seat assembly embodying the present invention;

FIG. 15 is a view similar to FIG. 12 but showing another form of table top wherein much of the table top surface is removable from a frame;

FIG. 16 is a sectional view taken along the line 16—16 in FIG. 15;

FIG. 17 is a side elevational view of yet another form of table top having means for releasably holding the table in collapsed condition;

FIG. 18 is an end elevational view looking from the left in FIG. 17; and FIG. 19 is an end view of the table illustrated in FIGS. 17 and 18, said table being shown in a folded and locked position.

DETAILED DESCRIPTION OF THE INVENTION

Figure 1:
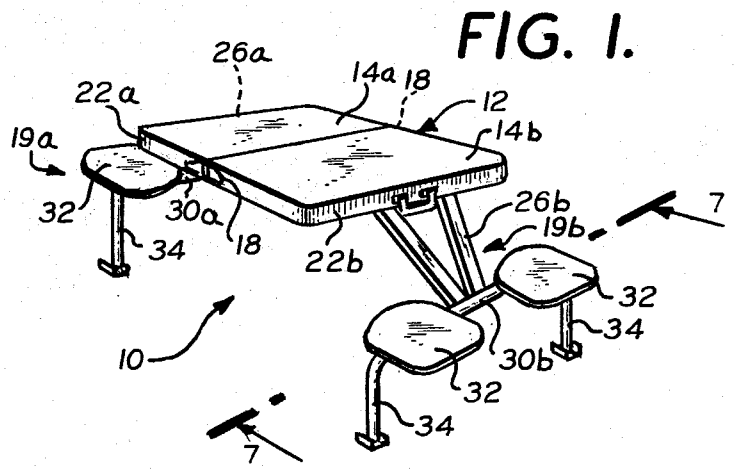
FIG. 1 is a perspective view of the folding table and seat according to the present invention.

Referring in detail to the drawings and initially to FIG. 1 thereof, designated generally by numeral 10 is a folding table and seat assembly according to the present invention, the assembly 10 being shown in perspective in a a fully opened position. Assembly 10 preferably comprises a table 12 having two identical table top halves **14*a* and 14*b* pivotally connected to one another at their abutting side edges by way of hinge plates 18, and a pair of seat assemblies 19*a* and 19*b* connected to the halves 14*a* and 14*b*, respectively, by table support members 26*a*, 26*b*. Each of the top halves 14*a*, 14*b* preferably has downwardly extending peripheral walls 22*a*, 22*b*, which define hollow regions underneath each of the top halves 14*a*, 14*b*, respectively, the regions acting as containers for the seat assemblies 19*a*, 19*b* when these assemblies are collapsed as will be described in greater detail hereinafter. In the preferred embodiment, the tabletop halves 14*a*, 14*b*, and their respective peripheral walls 22*a*, 22*b*** are formed from fiberglass, although any other suitable material may be used.

The table support members **26*a*, 26*b* are identical and are each pivotally connected at one end to the undersides of opposite ends of the table 12, respectively, while being fixedly joined at the other end to the respective seat assemblies 19*a*, 19*b* and particularly to the respective elongated seat support members 30*a*, 30*b*. The table support members 26*a*, 26*b* and the seat support members 30*a*, 30*b* are preferably separately formed and later welded together. The presently preferred material for the table support members 26*a*, 26*b* and seat support members 30*a*, 30*b*** is magnesium but, of course, any other material of comparable strength and rigidity may be used. However, it will be appreciated that magnesium provides both the advantages of light-weightedness and strength.

As further shown and preferred in FIG. 1, seat assemblies **19*a*, 19*b* each include a pair of seats 32 which are mounted on, each of the seat support members 30*a*, 30*b* by a way of pivotally mounted seat bases 36 which are described later in regard to FIG. 2. Legs 34 extend downwardly from the ends of each of the seat support members 30*a*, 30*b*, the legs 34 thereby supporting the weight of the entire table and seat assembly 10, as well as the weight of persons seated on the seats 32 when the assembly 10 is opened for use as shown in FIG. 1. The seats 32 are preferably made of plastic of suitable thickness and rigidity to support the weight of a seated person when the seats 32 are held in a cantilevered position as shown in FIG. 1, and the legs 34** are preferably formed from magnesium tubing, in keeping with the desire for both rigidity and light weight.

Figure 2:
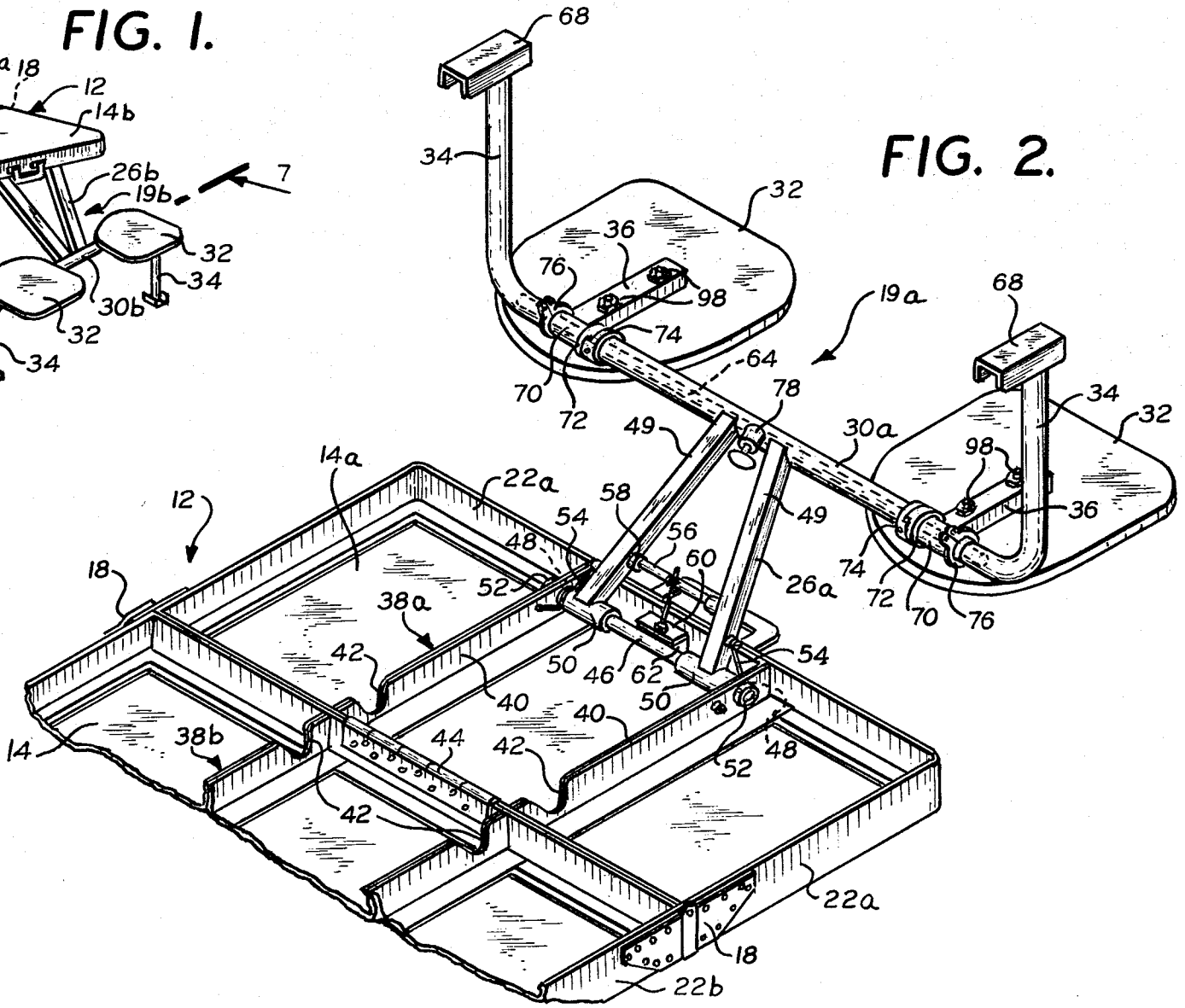
FIG. 2 is a fragmentary perspective view of the underside of the folding table and seat of FIG. 1.

Referring now to FIG. 2, the preferred seat assembly **19*a* is shown as pivotally connected to tabletop half 14*a*. Seat assembly 19*b* is, in the preferred embodiment, identically mounted to top half 14*b*** and therefore will not be described in further detail.

As shown in FIG. 2, a frame member **38*a*, preferably made also of magnesium, is fixedly joined to the underside of the tabletop half 14*a* to define two longitudinal supporting rib walls 40 underneath the top half 14*a*. Each of these rib walls 40 preferably has a cut-out region 42 shaped to accommodate the body of seat support member 30a when the seat support assembly 19a is swung down to a closed or collapsed position within the rib walls 40 as shown in dotted outline in FIG. 4**.

Each of the top halves 14a and 14b are secured to one another by way of hinge plates 18, with each of the hinge plates 18 being fastened to the outsides of the peripheral sidewalls 22, and by a hinge 44 connected to the insides of abutting peripheral walls 22a, 22b midway therealong, as shown. Thus, both tabletop halves 14a, 14b are connected to each other for relative pivotal movement about an axis substantially parallel to either of the ends of the table 12 from which the table support members 26a, 26b depend. Such pivotal movement is illustrated, for example, in FIG. 4.

As further shown in FIG. 2, one end of the table support member 26a has a pair of bosses 50 each formed at one end thereof, the bosses 50 having a circular aperture therein to accommodate an axle rod 46 which is also preferably made from magnesium. The axle rod 46 extends through corresponding opposed openings 48 in the rib wall 40, and through the bosses 50 to enable the pivotal connection between the support member 26a and the top half 14a. A pair of bushings 52 are each fixedly provided on the rib walls 40 at these openings 48 to strengthen the pivotal connections thereat.

Wire spring coils 54 are preferably provided between each of the rib walls 40 and the outer ends of the bushings 50, with the axle rod 46 extending through each of the spring coils 54. One end of each of these spring coils 54 is anchored to a corresponding rib wall 40 while the other end is anchored to the table support member 26a. The spring coils 54 act to maintain a bias torque on the table support member 26a which tends to rotate it outwardly from underneath the top half 14a towards an opened position.

Describing the table support member 26a in further detail, as shown and preferred, table support member 26a comprises a pair of tubular arms 49 each having an aforesaid cylindrical boss 50 at one end. In the presently preferred embodiment, tubular arms 49 have a square cross-section and are welded to their respective bosses 50 at one end, and to the seat support member 30 at their other ends. Extending between both of the arms 49 is a tubular cross-piece 56 which, in the preferred embodiment, is slip-fitted between projecting tubes 58 depending from each of the mutually opposed sides of the arms 49. An adjustable, swinging armature plate 60 has a threaded screw rod extending up therefrom and through apertures in the cross-piece 56 for lengthwise adjustment and locking with respect thereto. The screw rod is joined to the plate 60 by way of a flex ball joint as shown in FIG. 2. A block magnet 62 is preferably secured underneath the top half 14a at a location whereat the armature plate 60 will abut the magnet 62 and be held thereagainst to prevent further outward movement of the table support member 26a relative to the tabletop half 14a. Magnet 62 preferably exerts a 75 lb. pull on the plate 60. In the preferred embodiment, the plate 60 is made from steel, and the cross-piece 56 is made from cylindrical magnesium tubing.

It will be apparent that by connecting the armature plate 60 to the table support member 26a for relative free swinging movement, as described above, the plate 60 will line up transversely and longitudinally with magnet 62 so as to undergo maximum pull from the magnet. When plate 60 abuts the magnet 62, the holding force of the magnet will then act to lock table support member 26a in its opened position.

Figures 5, 6:
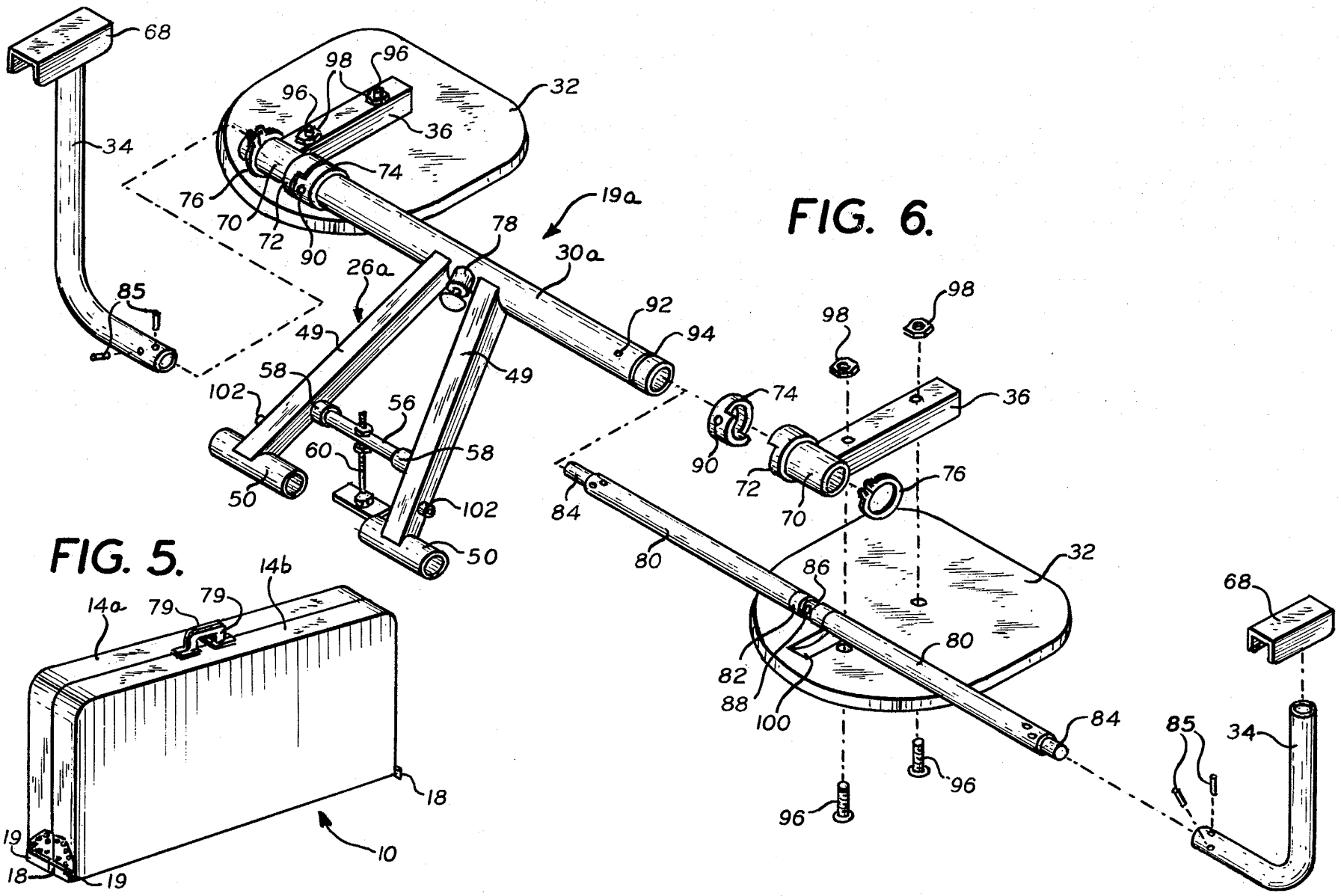
FIG. 5 is a perspective view of the folding table and seat of FIG. 1 in a fully closed position.
FIG. 6 is a perspective, partly exploded view of a portion of the folding table and seat of FIG. 1.

As may be more clearly seen in FIG. 6, locking nuts are preferably provided on the threaded rod joined to the plate 60 for preventing the rod from axial movement through cross-piece 56 once table support member 26a is swung open and plate 60 abuts block magnet 62. Thus, a minimum clearance can be maintained between arms 49 of the opened support member 26a and the peripheral wall 22a which extends down in the vicinity of the arms 49 from table top half 14a, by suitably adjusting the locking nuts about cross-piece 56. This feature eliminates pinch points on the wall 22a. Yet, additional stability is still provided for the opened table assembly 10 by way of the interaction between armature plate 60 and block magnet 62.

Continuing with regard to FIG. 2, the seat support member 30a, which is preferably welded to the ends of the arms 49 of the table support member 26a, comprises a tubular, preferably magnesium cylindrical body having a cylindrical bore extending axially therethrough. Coaxially disposed within said cylindrical bore for rotatable movement therein is a cylindrical shaft 64 to be described in further detail below in connection with FIG. 7. The shaft 64 is fixedly joined at each of its ends to legs 34, respectively. Thus, it will be appreciated that the legs 34 will move in unison with respect to one another by way of the common connection provided by the shaft 64. The bottom of each of the legs 34 has a foot 68 connected thereto, such as by welding or otherwise, for distributing the weight carried by each of the legs 34 over a predetermined area of the surface on which the legs 34 are to operatively stand. Seat assembly 19a also preferably comprises a pair of seats 32, connected to respective seat bases 36, which are mounted to the seat support member 30a for rotatable movement relative thereto between two fixed positions corresponding, respectively, to the opened and closed configuration for the table and seat assembly 10. Each of the seat bases 36 is preferably formed with a boss 70 at one end thereof, the bosses 70 each having a cylindrical aperture therein through which the seat support member 30a extends. Each of the bosses 70 has an arcuate protrustion 72 depending laterally from one side thereof and about a portion of the outer surface of the seat support member 30a. The protrusions 72 are preferably formed to abuttingly engage corresponding collars 74 fixedly joined to the seat support member 30a adjacent each of the bosses 70. Each of these collars 74 has an arcuate protrusion 90 extending towards the respective bosses 70 so that when each of the seats 32 are in their opened positions, they are prevented from further pivotal movement relative to the seat support member 30a by way of the protrusion 72 from the bosses 70 being brought into abutting relationship with the interfering arcuate protrusions 90 on the collars 74. Additionally, the bosses 70 are prevented from sidewise movement by the fixed collars 74 on one side thereof and retaining rings 76 provided, respectively, on the other sides thereof. The retaining rings 76 are conventional and are preferably made from steel. Retaining rings 76 are preferably seated in circumferential grooves cut into the seat support member 30a at locations in the vicinity of the ends thereof.

Figure 7:
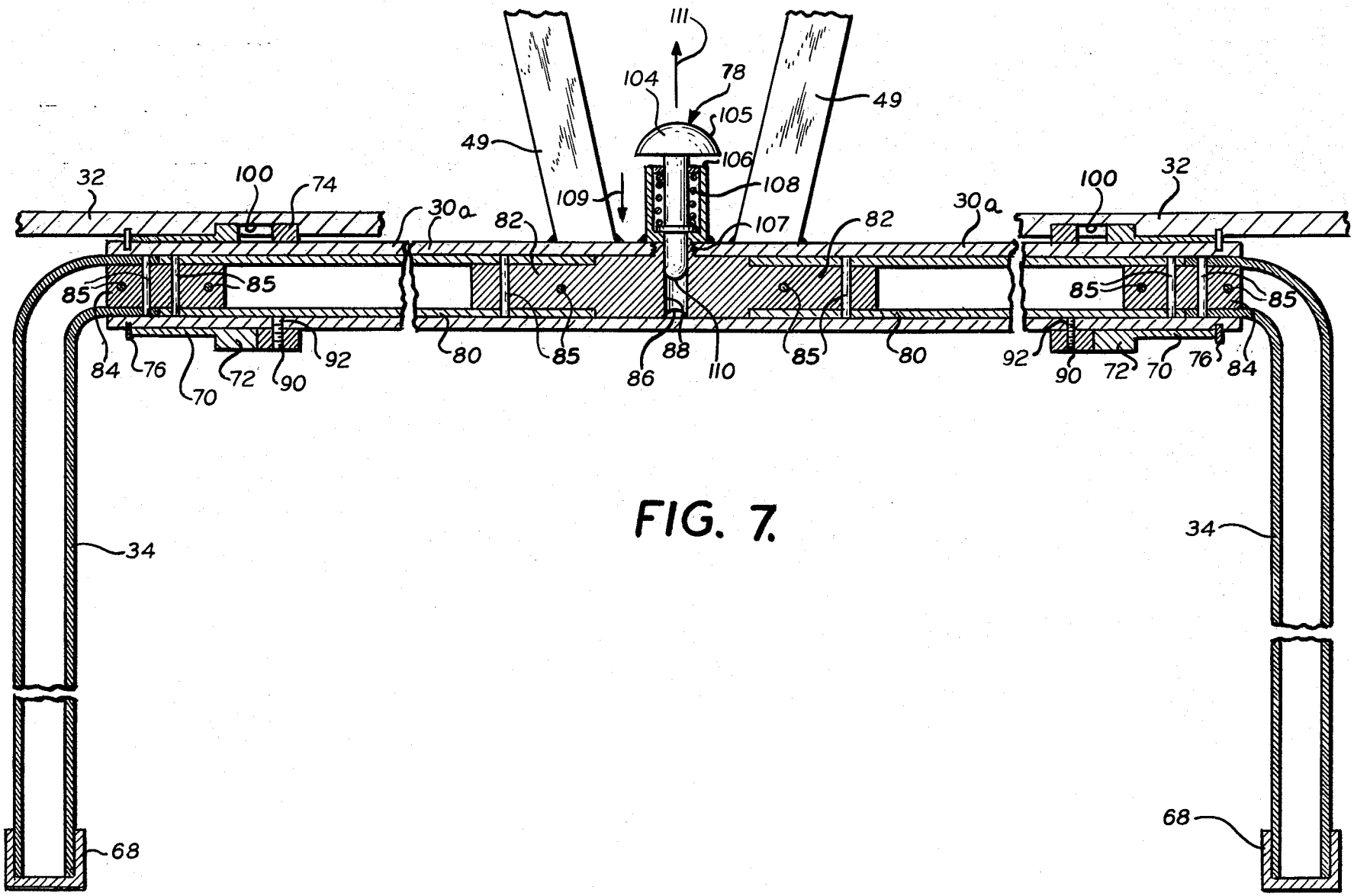
FIG. 7 is a sectional view taken along line 7—7 of FIG. 1 of a seat assembly portion of the folding table and seat of FIG. 1.

The circular connecting shaft 64 coaxially disposed within the seat support member 30a, as mentioned above, may preferably be locked at a position corresponding to the opened position for the legs 34, thereby preventing the legs 34 from pivotal movement in either direction when the table and seat assembly 10 is opened for use. This locking action, explained later in detail in connection with FIG. 7, is effected by way of a locking pin mechanism 78 in which a locking pin extends through apertures provided in the seat support member 30*a* and connecting shaft 64, these apertures being in registration with one another when the legs 34 are in their opened positions.

Figure 3:
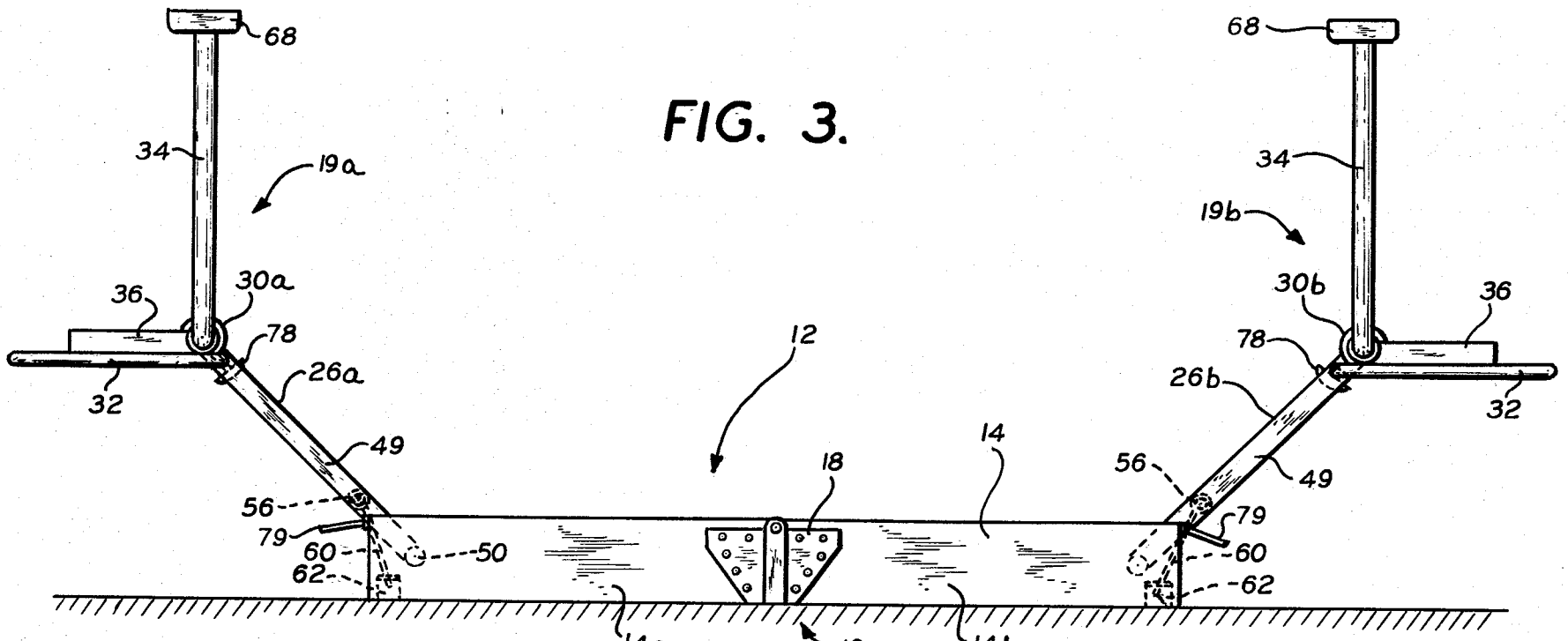
FIG. 3 is a side elevational view of the folding table and seat of FIG. 1 shown in a fully opened position and upside down from FIG. 1.
Figure 4:
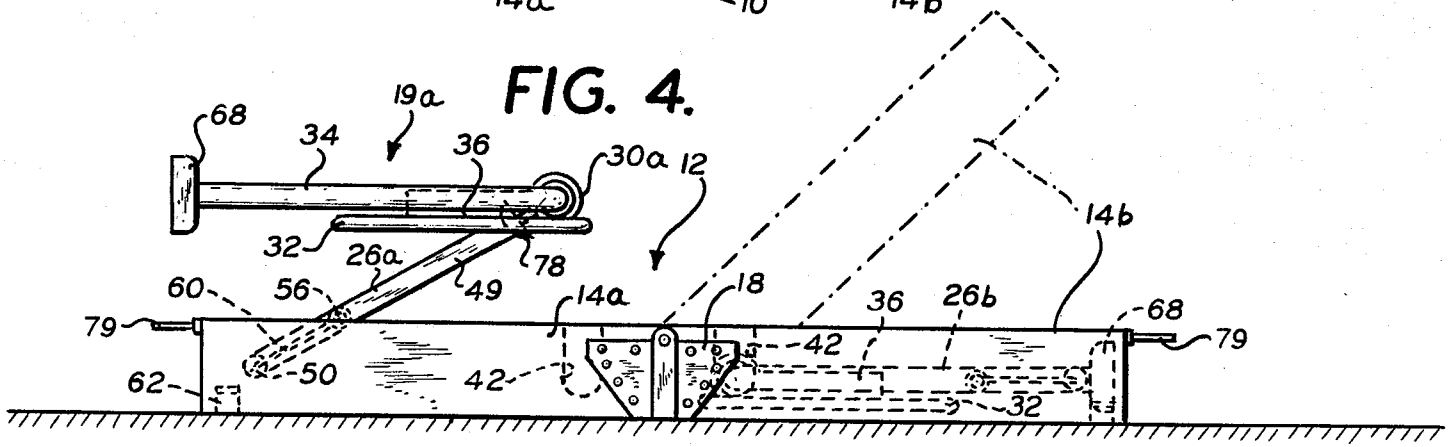
FIG. 4 is a side elevational view, similar to FIG. 3, of the folding table and seat of FIG. 1 shown in a partially collapsed position.

Referring now to FIGS. 3–5, the sequence of movement of the various elements comprising the present preferred table and seat assembly 10, when folded from an opened position (FIG. 3) to a closed position (FIG. 5) is illustrated. In the opened position, both halves 14*a*, 14*b* of the tabletop 12 define a substantially planar surface, the entire table and seat of the present invention being shown in an inverted position in FIG. 3 for purposes of illustration. However, it should be appreciated that the table and seat assembly 10 should preferably be collapsed by first placing it in an inverted position as shown in FIG. 3. This will allow the user to more easily force armature plate 60 away from block magnet 62 upon folding of the table support members 26*a*, 26*b*.

Operation of the table and seat assembly 10 will now be described in connection with FIGS. 3–5. The assembly 10 is folded preferably by first inverting it, as mentioned above, and then unlocking the legs 34 from their respective opened positions by operating the lock pin mechanism 78 which will be described in greater detail below. The legs 34 are then swung towards and held at a position whereat they are substantially parallel to the open table top 12. The table support members 26*a*, 26*b* are then swung inwardly towards a confronting, substantially parallel relationship with the underneath of each of the tabletop halves 14*a*, 14*b*. During the aforesaid movement, it will be appreciated that the seats 32 will be free to pivotally move relative to their associated table support members 26*a*, 26*b* by way of the previously described pivotal connections provided for each of the seats 32 between the seat bases 36 and the seat support members 30*a*, 30*b*. This movement of the table support member 26*a*, seats 32, seat bases 36, and legs 34 is depicted at the left-hand side of FIG. 4. It will also be appreciated that the armature plate 60 and its associated threaded rod (FIG. 3), which are free to swing with respect to the table support member 26*a*, may also be brought to a substantially parallel orientation relative to the table support member 26*a*.

After the table support members 26*a*, 26*b*, seats 32 and legs 34 are pivotally moved to a substantially parallel, confronting relationship with the undersides of each of the tabletop halves 14*a*, 14*b*, as shown at the right-hand portion of FIG. 4, the top halves 14*a*, 14*b* are then pivotally moved with respect to one another to a mutually confronting relationship to define the closed configuration for the present preferred table and seat assembly 10. This configuration is illustrated in FIG. 5. As also shown in FIG. 5, assembly 10 also preferably includes a pair of handles 79 provided at the outside ends of the top halves 14*a*, 14*b* which can be swung into abutting relationship with one another, so that the entire collapsed table and seat assembly 10 may be easily carried to another location for use or storage. In the closed configuration shown in FIG. 5, each of the hinge plates 18 preferably define a respective foot at the bottom of the closed table and seat assembly 10 by way of flanges 19 formed on each of the halves of the hinge plates 18. These flanges 19 overlap one another when the hinge plates 18 are in their opened positions.

FIG. 6 is an exploded, perspective view of the preferred seat assembly 19*a* including table support member 26*a* and the seat support member 30*a*. FIG. 6 illustrates the ease with which the preferred table and seat assembly 10 may be fabricated. Thus, as shown therein, the cylindrical shaft 64 preferably comprises two tubular magnesium half shafts 80, with a cylindrical coupling 82 axially joining each of the half shafts 80. The coupling 82 is preferably formed from case hardened cold rolled steel. Extending from the outside ends of each of the half shafts 80 are plugs 84 which are formed preferably from solid magnesium. The coupling 82 and the plugs 84 are all fixedly joined to the half shafts 80 by way of case hardened, cold rolled steel pins 85, for example. Coupling 82 preferably has a circumferential groove 86 cut midway therearound, and a circular aperture 88 extending diametrically through the coupling 82 within the groove 86. As shown later in FIG. 7, the aperture 88 is arranged to be registrable against a corresponding aperture provided through the seat support member 30*a* to allow a pin in the locking mechanism 78 to pass through both of these apertures when the legs 34 are in their opened positions.

Continuing with reference to FIG. 6, the collars 74, each having the aforementioned laterally extending arcuate protrusion 90, are placed over the seat support member 30*a* and fixedly secured thereto at particular locations such as by way of dog point set screws (FIG. 7) which engage corresponding apertures 92 provided on the seat support member 30*a*. As also shown and preferred in FIG. 6, each of the tubular legs 34 has a right angle bend at the top thereof whereby the legs 34 engage respective ones of the plugs 84 extending from the ends of the half shafts 80, and are fixedly joined thereto by way of roll pins 85. The seat bases 36, as previously mentioned, are pivotally mounted on the seat support member 30*a*, and such mounting is accomplished by sliding the respective bosses 70 over the seat support member 30*a* into abutting relationship with the secured collars 74. The seat bosses 36 are preferably retained from sidewise movement by way of the retaining rings 76 which are expanded to slide over the seat support member 30*a*, and released to seat within circumferential grooves 94 cut into the seat support member near each of its ends.

Each seat 32, as shown in FIG. 6, is preferably joined to its respective seat base 36 by way of fasteners 96 which extend through the seat 32 and corresponding openings provided in the seat base 36. Locking nuts 98 are also preferably provided, although it is understood that the fasteners 96 may engage threads provided within the openings in the seat base 36 to effect a secure connection. In the presently preferred embodiment of the assembly 10, the underside of the seat 32 has a recessed region 100 cut therein to accommodate an enlarged end portion on the boss 70, the aforementioned arcuate protrusion 72 extending from this enlarged portion of the boss 70.

Still referring to FIG. 6, each of the arms 49 of the table support member 26*a* preferably has a stud member 102 formed on the outside walls thereof to anchor one end of the previously mentioned bias spring coil 54 (FIG. 2).

Turning now to FIG. 7, there is shown in sectioned view the seat support member 30*a*, the circular shaft 64 connecting each of the legs 34, which shaft 64 is coaxially rotatably disposed within the seat support member 30*a*, and the locking mechanism 78 which acts to lock the legs 34 in their opened positions. In particular, the locking mechanism 78 which may be conventional, is preferably made of magnesium and has a locking pin 104 made of case hardened, cold rolled steel. Locking mechanism 78 preferably includes a housing 106 at the bottom of which a threaded bushing 107 extends to engage a corresponding threaded circular aperture provided in the seat support member 30*a*. The locking pin 104 is preferably biased toward a downward position in which the bottom of the locking pin 104 extends through the circular aperture 88 provided in the coupling 82 which joins the half shafts 80. The aforementioned downward bias in the direction of arrow 109 is preferably provided by means of a conventional spring 108 through which pin 104 extends within housing 106. Pin 104 preferably includes a ring 110 fixedly joined to the body of the pin 104, the ring 110 being forcibly seated against the bottom of the housing 106 by the action of the spring 108 bearing against the ring 110 when the pin 104 is in its locking position. It will be appreciated that to withdraw the pin 104 from its locking position in aperture 88 in the coupling 82, an upwardly directed force as shown by the arrow 111 is applied to the pin head 105. The spring 108 is thereby compressed between the ring 110 and the inside of the top wall of the housing 106. When the pin 104 is so withdrawn from the aperture 88, the legs 34 can be freely pivotally moved in unison by way of the connection provided between the legs 34 by the half shafts 80 and the coupling 82. The upward force applied to the pin 104 can then be removed and the bottom of the pin 104 will now freely slide within the circumferential groove 86 on the coupling 82, provided the aperture 88 remains out of alignment with locking pin 104. Of course, the legs 34 can be again locked in their opened position by swinging them in unison towards that position until the locking pin 104 is forcibly extended through the aperture 88 by the action of the spring 108.

It will be obvious to anyone skilled in the art that the various components heretofore described may be made from a large variety of suitable materials. Some of these materials have already been described in relation to the particular components, and include magnesium and steel. However, for example, the legs 34 can be made of wood, plastic, fiberglass reinforced plastic or metal. Although the legs have been described as tubular, they can, of course, be substantially solid. The choice of materials other than those described herein for particular components is well within the ability of the skilled art worker, and any further description thereof is deemed unnecessary.

Figure 8:
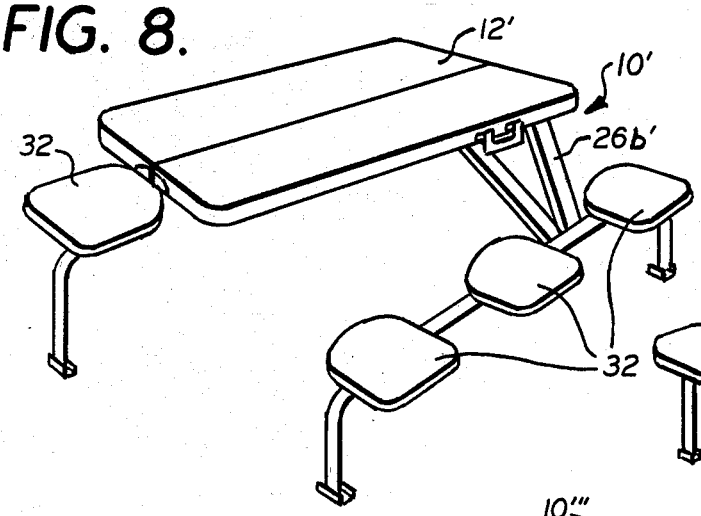
FIG. 8 is a perspective view of another form of combined collapsible folding table and seat assembly in accordance with the present invention.

While the collapsible combined table and seat assembly having two seats on each side of the table, as already described, is the presently preferred form of my invention, other seating arrangements may be employed without departing from this invention. Thus, as illustrated in FIG. 8, the assembly 10' comprises a table 12' constructed exactly like the table 12 of FIG. 1, save for proportioning, and three seats 32 on each side of the collapsible table 12' (instead of two shown in FIG. 1), the seats being connected to the table by table support members 26*b* extending upwardly between any two adjacent seats on each side. Preferably, when viewing from the vantage of FIG. 8, if the member 26*b'* on the near side of the table 12' extends up between the central seat and the right hand seat, then the member 26*b* on the far side of the table 12' will extend up to the table 12' between the left hand seat 32 and center seat 32, whereby to give better support and stability to the table top 12'. However, the assembly will function with both members 26*b* on the same side. Alternatively, two members 26*b'* could extend up from each side of the central seat 32. Of course, such an arrangement would make if difficult to employ the central seat 32 on each side of the table 12'.

Figure 9:
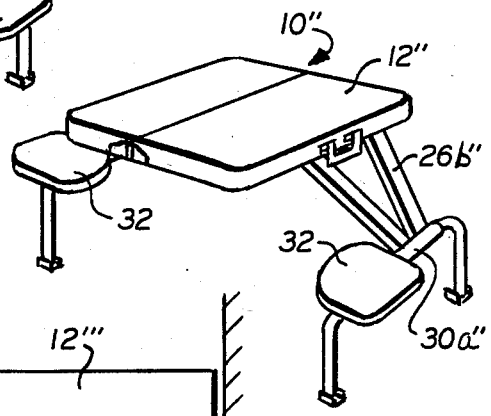
FIG. 9 is a view similar to FIG. 8 showing yet another form of the present invention.

Referring now to FIG. 9, a combined collapsible table and seat assembly 12'' is shown wherein only one seat 32 is provided on each side of the table 12''. Thus, the assembly 10'' is in all respects the same as the assembly 10 of FIG. 1 save for the fact that the dimensioning of the center part 30*a''* in each of the leg assemblies for seat 32 is shorter than that encountered in the FIG. 1 embodiment. As shown in FIG. 9, the table support members 26'' on both sides of the table 12'' extend upwardly from the right as viewed from the vantage of FIG. 9. Of course, one may extend up from the left and the other from the right without departing from this invention.

Figure 10:
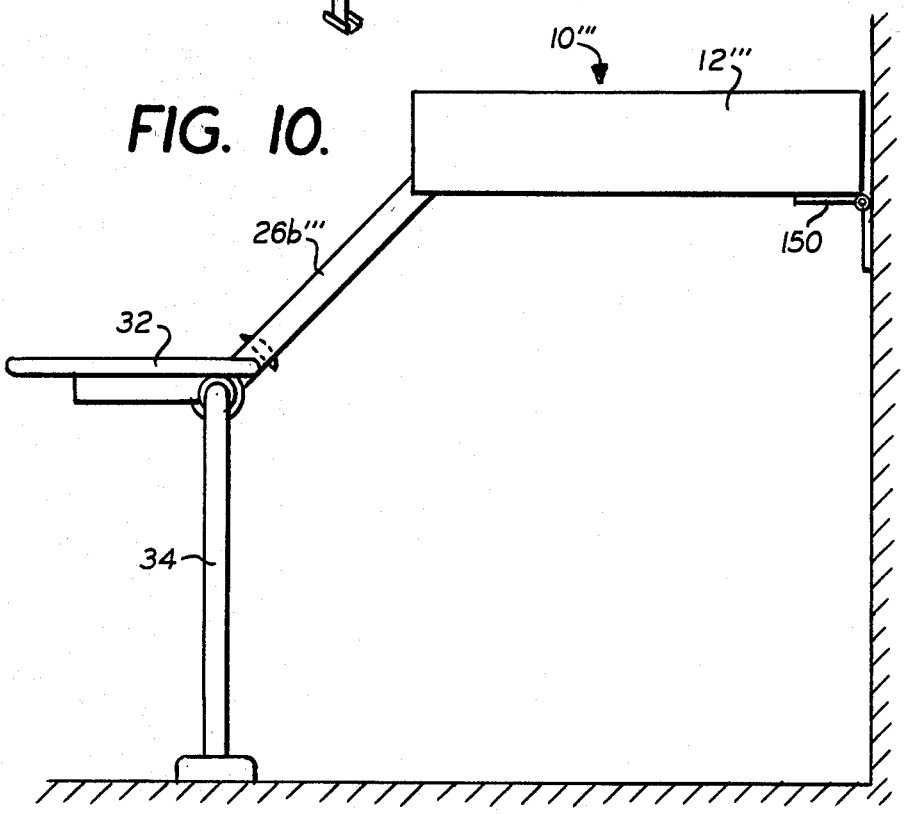
FIG. 10 is a side elevational view of yet another form of the present invention.

Referring now to FIG. 10, a wall mounted collapsible table and seat assembly embodying the present invention is shown for use with a single seat 32 of the same construction as that used in FIG. 1. Basically, the structure of the assembly 10''' is identical to the structure of the assembly 10'' on one side of the table center fold line. Of course, since the table 12''' is to be mounted on a wall, a suitable hinge 150 is connected to the bottom of the table top 12''' and to the wall. The entire assembly is proportioned so that it may be collapsed up into the table 12''' in the same manner as the seats collapse into the bottom of the one-half of the table 12 in the FIG. 1 embodiment and then the collapsed assembly can be swung down along the wall to be out of the way when not in use. Clearly, more than one seat may be used adjacent the unhinged end of table 12'''.

The assembly ten'''' of FIG. 11 is identical to the assembly 10''' of FIG. 10 save that it is not wall-mounted. Instead, the hinge 150 is connected to a collapsible leg (or legs) 152 that is hinged at its center 154 for collapse in order for it to be able to fit up into the interior of the table 12''''. Any suitable means may be employed in connection with the hinge 154 to hold the leg 152 rigidly erect when in use. For illustrative purposes, only, but as now presently preferred, a simple slide bolt means 156 may be used for this purpose. Again, although only one seat 32 is shown along the end of Table 12''', more than one may be employed.

Figure 12:
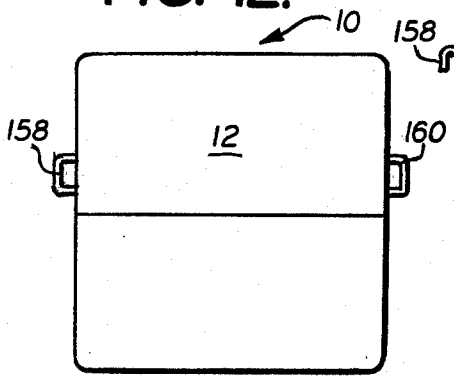
FIG. 12 is a top plan view of the table top of a combined collapsible table and seat assembly wherein the seat assembly is collapsed within the table top, said table top having means for interlocking it with adjacent similar tables.
Figure 13:
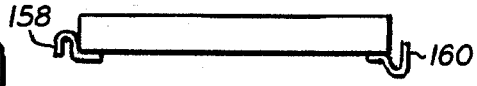
FIG. 13 is a side elevational view of the table of FIG. 12.

Irrespective of which of the seating arrangements is employed in an assembly embodying the present invention, when such assemblies are used for institutional use, such as to convert a gymnasium to an auditorium or the like, it may be desirable to interconnect adjacent assemblies in order to prevent ready movement thereof when once located. A variety of means may be employed to effect this detachable connection of adjacent substantially identical assemblies and the preferred form of such means is illustrated in FIG. 12. Referring to FIG. 12, it will be seen that extending outwardly from one side of the table 12 is a downwardly extending hook 158 and extending upwardly from the other side of table 12 is an upwardly extending hook 160. The hooks 158 and 160 are proportioned to interengage. If all of a line of assemblies 10 are provided with such hooks 158 and 160, then the confronting left and right sides of adjacent tables may have their hooks 158 and 160 interconnected whereby to hold adjacent tables fixed relative to one another. It will be obvious, of course, that other means of effecting such detachable interconnection may be employed, such as, for example, the use of a protruding rod on one side and a complimentary aperture on the other side of the table 12 which may slide together, the use of a flange and slotted receptacle on opposite sides or interengagement or any other means well known to the person of ordinary skill in the art.

The seats 32 and the table tops 14*a* and 14*b* may be made of any suitable material, preferably a lightweight material such as wood, sheet metal, sheet aluminum, fiberglass reinforced plastic or the like. Most preferably, the material is a very lightweight material and to this end composite structures such as honeycomb cores may be employed. Among materials which may be useful for forming the table top halves 14*a* and 14*b* are materials formed by foam injection molding, such as, for example, polystyrene, polycarbonate, polyvinylchloride, low molecular weight polyethylene, polypropylene, or other similar material capable of being foam injection molded. Such materials, and the process of foam injection molding them, are described in a number of U.S. patents, some of which are listed hereinafter: Nos. 3,058,161; 3,211,605; 3,268,636; 3,384,691; 3,436,446; 3,599,290; 3,674,401; and 3,746,492. The contents of said patents are hereby incorporated in their entireties.

Figure 14:
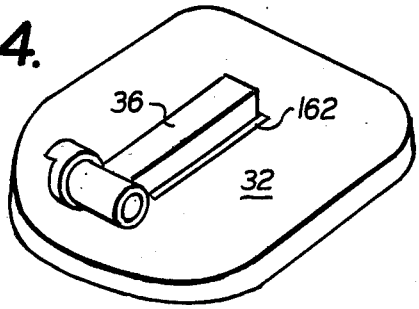
FIG. 14 is a perspective view of a modified seat wherein the seat support has been molded integrally with the seat itself.

If the seats 32 are made of such foam injection molded materials, it may be desirable to mold the seat bases 36 to the bottom of the seats 32 rather than to bolt them by the nuts and bolts 98 as shown in FIG. 2. Such an integrally molded product is shown in FIG. 14. Of course, certain modifications in design may be incorporated to accommodate the integral molding such as providing the side walls of the base 36 with a slight draft to enable removal of the part from the mold and the inclusion of a fillet 162 along the edge between the seat bottom 32 and the confronting surface of the base 36. However, these modifications are well within the ability of a person of ordinary skill in the art.

If it is desired, to lighten the weight of the collapsed assembly for carrying, the table 12 may be provided on each table half 14*a* and 14*b* with a removable panel 164*a* and 164*b* so that the panels may be carried separately from the collapsed assembly. Numerous means may be employed to accomplish this desirable end and one such means, presently preferred, is illustrated in FIGS. 15 and 16. Specifically, each of the table halves 14*a* and 14*b* is essentially made of a frame of suitable material such as metal, or plastic or wood, all preferably lightweight. Secured to the bottom of the frame 166*a* and 166*b* are a plurality of inwardly directed tabs 168 which are distributed about each of the frames 166*a* and 166*b*. Thus, for example, the tabs may be affixed to the frame as by adhesives, securing elements such as screws or rivets, welding or soldering or the like, as may be appropriate, depending upon the selected material. With the tabs so provided on the peripheral frames 166*a* and 166*b*, when the assembly is unfolded and set up for use, all that is required is to drop the panels 164*a* and 164*b* inside of their respective frames in which event they will come to rest against the upper surfaces of the tabs 168*a* to define the table top 12. This would enable the table tops to be made of somewhat heavier material, although, preferably, the panels will continue to be made of lightweight material such as the foam injection molded plastic hereinbefore mentioned.

It will be recognized that a variety of alternative means may be employed to hold the collapsible combined table and seat assembly of the present invention, in whatever form, in the closed position. One especially suitable means for holding the assembly in collapsed and folded condition is shown in FIGS. 17, 18 and 19. In accordance FIGS. 17, 18 and 19, and in accordance with a number of alternative constructions useable with any of the structures heretofore described, the two table top portions 14*a* and 14*b* may be hingedly connected by a piano hinge 170 extending the full width of the table, rather than by the hinge 44 which only extends along a portion thereof. Suitable abutment means must be provided to accomplish the design as shown in FIG. 7, but such redesign is well within the ability of the skilled art worker.

To hold any of the tables 10 in their closed or folded positions, and as illustrated in FIGS. 17, to 19, affixed to the lower edge of both ends of the table 12 is an L-shaped molding 172 in which the horizontal leg of said molding is secured to the bottom of the ends of the table top 12 and the vertical portion extends upwardly therefrom in spaced relation with said end when said table is unfolded as shown in FIG. 17. Slidably mounted on each of said molding 172 is a channel or C-shaped clip 174. The molding 172 along each end of the table is not continuous, but is broken as at 176 to accommodate the portion of the clip 174 depending from the railing 172 in the open position of FIG. 17. The reason for this will become apparent presently.

When the table 12 is pivoted to its closed position either about the hinge 170 or the hinge 44 or any other pivotal mounting means for the two table top portions 14*a* and 14*b*, each of the clips 174 will be located on its associated railing to register with the gap 176 in the railing on the opposite end of the table, which opposite end will not be in confronting relation, as may be seen in FIG. 19. Thus, the clip will assume the position shown in FIG. 18 and then may be slid toward the center or handle portion 79 whereupon each clip will slide over the molding 172 belonging to the opposed end of the table top 12 to hold the table tops in the closed position as shown in FIG. 19. However, when it is desired to open such folded and locked table top and seat assembly 10, all that need be done is to slide the two clips 174 outwardly from the handles whereby to bring each of the clips into register with the gaps 174 associated with the molding on the opposite end of the table top whereby to unlock the table top for pivotal movement back to the condition shown in FIG. 17.

The various assemblies described herein have numerous uses. In addition to serving as a portable picnic table and seat assembly which may be carried in the trunk of an automobile, these assemblies are extremely useful in homes, offices, schools, auditoriums or the like, as earlier stated. Of course, many other uses than those enumerated above will be apparent to one of ordinary skill in the art.

While I have herein shown and described the preferred forms of this invention and have suggested modifications therein, other changes and modifications may be made thereto without departing from the spirit and scope of this invention as defined in the appended claims.

What is claimed as new and desired to be secured by Letters Patent is:

1. In a folding table and seat assembly of the type wherein said seat and table are relatively pivotally movable between an opened position wherein said table and seat are substantially parallel to one another and said seat is disposed adjacent and below one end of said table, and a closed position wherein said seat is in confronting, substantially parallel relation with said table, an improved assembly for supporting said table and seat in said opened position and for permitting said pivotal movement, said assembly comprising:

a table support member connected at one end thereof to the underside of one end of said table for pivotal movement with respect to said table between first and and second positions corresponding, respectively, to said opened and folded positions;

an elongated seat support member fixedly joined to the other end of said table support member, said seat support member comprising an elongated cylindrical tubular member having a circular axial bore extending therethrough, the axis of said tubular member being substantially parallel to the pivotal axis of said table support member;

a seat base connected to said seat and including a boss having a circular aperture thereon, said seat support member pivotally extending through said circular boss aperture, cooperating stop means on said circular boss and on said seat support member for limiting the pivotal movement of said seat base relative to said seat support member between two extreme positions corresponding to said open and closed positions; and a pair of elongated legs and means for mounting said legs to said seat support member for pivotal movement relative to said seat support member, said legs being shaped to move to a closed position in which they confront and are in substantially a parallel relationship with said table when said table and seat assembly are in said closed position, said leg mounting means including a circular shaft operatively coaxially extending through said axial bore in said seat support member for pivotal movement therein, each of said legs being connected to respective ends of said shaft for pivotal movement therewith between an open position in which said legs extend vertically when said table is in an elevated horizontal position and said closed position, and means for releasably holding said legs in said open position.

2. The folding table and seat assembly of claim 1, further comprising means connected to said other end of the table for supporting said other end in an elevated position.

3. The folding table and seat assembly of claim 2, wherein said means for supporting said other end comprises another table support member, another elongated seat support member, and another pair of elongated legs operatively connected to one another and to the other end of said table as are the corresponding elements at said one end of the table.

4. The folding table and seat assembly of claim 2, wherein said table comprises a pair of tabletop portions pivotally connected to one another for relative movement about an axis extending substantially parallel to said two table ends between an open position in which the two portions are coplanar and a closed position in which they are in close confronting relation.

5. The following table and seat assembly of claim 1, wherein said elongated seat support member and said circular shaft each have a radially extending aperture which register when said legs are in said open position, and wherein said means for releasably holding said legs in said open position comprises a pin removably positioned in said registered aperture.

6. The folding table and seat assembly of claim 3, wherein said releasable holding means comprises a boss depending from each of said seat support members, said bosses defining an aperture in each of said seat support members, each of said circular shafts having an aperture therein which is registrable with the corresponding aperture in said bosses, repsectively, when each said pair of legs are in said open position, and corresponding lock pins operatively extending through the registered apertures in each of said bosses and associated circular shaft, whereby to lock said legs against pivotal movement relative to their associated seat support members, and to unlock said legs against said pivotal movement when the corresponding lock pin is withdrawn from its associated registered aperture.

7. The folding table and seat assembly of claim 1, further comprising a pair of spaced apart seats each mounted, respectively, to a said seat base, said table support member is fixedly secured to said seat support member at a location between said seats, and each said leg extends downwardly from said seat support member in the vicinity of a corresponding one of said seats when said legs are in opened positions, respectively.

8. The folding table and seat assembly of claim 1, wherein said cooperating stop means for limiting movement of said seat base relative to said seat support comprises a second boss fixed to said seat support member, said first and second mentioned bosses including complementing arcuate longitudinally extending protrusions engageable when said seat support member is in said open condition for holding said seat in said open position.

9. The folding table and seat assembly of claim 1, further comprising spring means for biasing said table support member to said opened position.

10. The folding table and seat assembly of claim 1, and cooperating magnetic means secured to said table and to said table support member for releasably holding said table support member in said opened positions.

11. The folding table and seat assembly of claim 9, and cooperating magnetic means secured to said table and to said table support member for releasably holding said table support member in said opened positions.

12. The folding table and seat assembly of claim 11, further comprising means for supporting the other end of said table including another table support member, another elongated seat support member, and another pair of elongated legs, another spring means, and another cooperating magnetic means, all of the elements of said means for supporting the other end of said table being connected to one another and to said other end of the table as the corresponding elements at said one end of the table.

13. The folding table and seat assembly of claim 1, further comprising a second of said seat bases including an apertured boss through which said seat support member pivotally extends, and a second seat connected to said second seat base, said first and second seat bases and their respective seats being spaced apart along said seat support member, and wherein the other end of said table support member is fixedly joined to said elongated seat support member between said two seats.

14. The folding table and seat assembly of claim 11, wherein said cooperating stop means for limiting movement of said seat base relative to said seat support comprises a second boss fixed to said seat support member, said first and second mentioned bosses including complementary arcuate longitudinally extending protrusions engageable when said seat support member is in said open condition for holding said seat in said open position.

15. The folding table and seat assembly of claim 5, and further comprising a spring for biasing said pin into said removable position.

16. The folding table and seat assembly of claim 15, further comprising a hollow base as said seat support member in axial alignment and surrounding relation with said apertures and housing said spring, said spring being a compression spring, said housing including a top wall engaging said spring at its outer end, said pin including a flange engaging said spring at said inner end.

17. The folding table and seat assembly of claim 14, wherein said elongated seat support member and said circular shaft each have a radially extending aperture which register when said legs are in said open position, and wherein said means for releasably holding said legs in said open position comprises a pin removably positioned in said registered apertures, a spring for biasing said pin into said removable position, a hollow base as said seat support member in axial alignment and surrounding relation with said apertures and housing said spring, said spring being a compression spring, said housing including a top wall engaging said spring at its outer end, said pin including a flange engaging said spring at said inner end.

18. The folding table and seat assembly of claim 1, wherein said seat support member and said seat are integral.

19. The folding table and seat assembly of claim 1, wherein said table comprises a peripherally extending frame, a panel disposable within said frame, and means for holding said panel within said frame.

20. The folding table and seat assembly of claim 4, further comprising a handle secured to each of said two table ends, said handles being in close confronting relation when said two tabletop portions are in their closed positions.

21. The folding table and seat assembly of claim 4, and means for releasably holding said two tabletop portions in their closed positions.

22. The folding table and seat assembly of claim 20, and means for releasably holding said two tabletop portions in their closed positions.

23. The folding table and seat assembly of claim 1, and a pair of complementary connecting members, one connected to each side of said table, for connecting said table to an adjacent substantially identical table.

24. The folding table and seat assembly of claim 17, and a pair of complementary connecting members, one connected to each side of said table, for connecting said table to an adjacent substantially identical table.

* * * * *